US006591722B1

(12) United States Patent
Sauer

(10) Patent No.: US 6,591,722 B1
(45) Date of Patent: Jul. 15, 2003

(54) BOOK RECYCLING APPARATUS

(76) Inventor: Donald Sauer, 566 Country Rd., Meadow Vista, CA (US) 95722

( * ) Notice: Subject to any disclaimer, the term of this patent is extended or adjusted under 35 U.S.C. 154(b) by 0 days.

(21) Appl. No.: 09/697,664

(22) Filed: Oct. 25, 2000

(51) Int. Cl.[7] ..... B26D 1/15

(52) U.S. Cl. ..... 83/107; 83/155; 83/435.2; 83/933; 198/689.1

(58) Field of Search ..... 83/155, 155.1, 83/933, 934, 435.2, 100, 107; 198/689.1

(56) References Cited

U.S. PATENT DOCUMENTS 2,584,346 A * 2/1952 Havely
2,589,673 A * 3/1952 Cobb
2,618,334 A * 11/1952 Cobb
3,074,304 A * 1/1963 Cole ..... 83/456
3,207,017 A * 9/1965 McCain ..... 83/27
3,240,089 A * 3/1966 Chamberlain et al. ..... 83/861
3,431,805 A * 3/1969 Marshall
3,722,342 A * 3/1973 Vulcano ..... 83/73
3,732,766 A * 5/1973 McCain et al. ..... 83/104
3,733,947 A * 5/1973 Bryson et al. ..... 83/280
3,808,931 A * 5/1974 Vulcano ..... 83/409
3,841,182 A * 10/1974 Cosgrove et al. ..... 83/89
3,884,102 A * 5/1975 Faltin ..... 83/152
4,075,917 A * 2/1978 Kistner et al. ..... 83/422
4,076,231 A * 2/1978 Kutzner et al. ..... 270/52.17
4,385,537 A * 5/1983 Wolf ..... 83/100
4,445,407 A 5/1984 Lucas
4,506,571 A 3/1985 Jensen et al.
4,566,360 A * 1/1986 Lehmann ..... 83/409
4,648,779 A * 3/1987 Weitzman ..... 83/451
4,739,910 A * 4/1988 Westphal et al. ..... 223/37
5,086,681 A * 2/1992 Ruetschle et al. ..... 83/277
5,279,095 A * 1/1994 Muller ..... 53/386.1
6,012,367 A 1/2000 Westra et al.
6,152,001 A * 11/2000 Faustmann ..... 83/32
6,234,054 B1 * 5/2001 Heutschi ..... 83/155

OTHER PUBLICATIONS

Nortech Incorporated SA1800 Book DeBinder Brochure.
Nortech Incorporated HC1500 Book DeBinder Brochure.
Nortech Incorporated DB900 Book DeBinder Brochure.

* cited by examiner

*Primary Examiner*—Kenneth E. Peterson
(74) *Attorney, Agent, or Firm*—Thomas R. Lampe

(57) ABSTRACT

An apparatus for separating the spine, cover portion, and pages of a book utilizing a holding structure for supporting the book in a certain position. While supported by the holding structure, the book is transported to a cutter where the cutter severs the spine from the remainder of the book. The cover and pages are then conveyed from contact with the cutter and the cover is separated from the pages.

5 Claims, 4 Drawing Sheets

BOOK RECYCLING APPARATUS

BACKGROUND OF THE INVENTION

The present invention relates to a novel and useful book recycling apparatus.

The recycling of used and discarded books is a desirable objective. However, it has been found that simple recycling techniques applicable to newsprint and like materials does not apply to books. A problem exists in that glues used to fasten covers to pages of a book cause chemical imbalance problems when books are reprocessed into a pulp material. In addition, covers of certain books, especially hardbacks, are not easily processed due to non-paper materials, coatings, and the like. Thus, it is imperative that the binding and cover portions be separated from a book prior to recycling of the pages within the book.

In the past, binding portions of books have been separated manually. This, of course, it is a difficult and time-consuming task.

U.S. Pat. No. 6,012,367 describes a document trimming apparatus in which a stack of sheets are positioned on a surface and trimmed by a knife.

U.S. Pat. No. 4,506,571 describes a machine for removing bookbindings in which a book is positioned on a surface and the binding is separated from the remainder portions of the book by a swinging knife assembly.

U.S. Pat. No. 4,445,407 describes a method and apparatus for handling book trimmings in which a guillotine blade separates the binding of the book from the remainder portion. The binder is then processed through an assembly in which the cover portions are further separated from the pages found in the binding by a pair of rotating blades.

An apparatus for easily removing and separating pages from a book in a unitary operation would be a notable advance in the field of recycling of materials.

BRIEF SUMMARY OF THE INVENTION

In accordance with the present invention a novel and useful apparatus for separating the spine, cover portion, and pages of a book is herein provided.

The apparatus of the present invention utilizes a holding structure for supporting a book in a certain position where the spine of the book extends outwardly from the holding structure. Such structure may take the form of a pair of closed loop belts each biased toward one another by a plurality of opposed rollers. Means is also included for conveying the book along a particular path. The book would be fed into the space or channel between the belts from a platform which lies below the extremity of the belts. Thus, the book is held between and moves with the belts such that the spine of the book is exposed.

A cutter is positioned below the belts to severe the spine from the remainder of the book. Such cutter may take the form of a rotating blade which rotates in the direction of the movement of the book at a slightly greater speed than the movement of the book with the opposing belts. That is to say, the rollers supporting the belts may also include a driving mechanism which serves as such means for conveying the book supported by the holding structure. Such driving member may take the form of a motor which is capable of rotating one or more of the rollers, rendering the remaining rollers as ones which passively rotate and bias a particular belt.

Means is also included for conveying the cover portion and pages beyond the point of contact of the book with the cutter. That is to say, the binding severed from the book by the cutter separates and is conveyed away from the apparatus at this point. The cover portion and the pages are conveyed away from the cutter for further processing.

Means is also provided in the present invention for separating the cover portion from the pages of the book. Such means may externalize in utilizing the same close loop belts to further move the cover portion and pages of the book away from the cutter. Following such movement, a vacuum or suction force is applied to each belt to hold the cover portion thereto. At this point, the pages of the book would separate from the cover portion and be conveyed away from the apparatus. Finally, the cover portion of the book would reach the end of the closed loop belts and be positioned in a third conveyor or container for disposal.

It may be apparent that a novel and useful apparatus for separating parts of a book for the purpose of recycling has been hereinabove described.

It is therefore an object of the present invention to provide to an apparatus for separating parts of a book for the purpose of recycling which achieves such result automatically following the feeding of a book into the apparatus.

Another object of the present invention is to provide an apparatus for separating parts of a book for the purpose of recycling the same in which spine and cover portions are segregated from the pages of the book in an efficient manner.

A further object of the present invention is to provide an apparatus for separating parts of a book for the purpose of recycling the same which is capable of processing soft and hard cover books without loss of efficiency.

Another object of the present invention is to provide an apparatus for separating the parts of a book for the purposes of recycling the same which processes books at a rapid rate compared to devices and processes of the prior art.

Another object of the present invention is to provide an apparatus for separating parts of a book for the purpose of recycling the same which is economical and may be operated to recover the cost of the apparatus in a short period of time.

Another object of the present invention is to provide an apparatus for separating parts of a book for the purposes of recycling the same in which the apparatus includes components that are easily obtainable and maintained during operation of the apparatus.

The invention possesses other objects and advantages especially as concerns particular characteristics and features thereof which will become apparent as the specification continues.

For a better understanding of the present invention reference is made to the following detailed description of the preferred embodiments which should be referenced to the above-described drawings.

DETAILED DESCRIPTION OF THE PREFERRED EMBODIMENTS OF THE INVENTION

Various aspects of the present invention will evolve from the following detailed description of the preferred embodiments thereof which should be referenced to the hereinabove delineated drawings.

Figure 1:
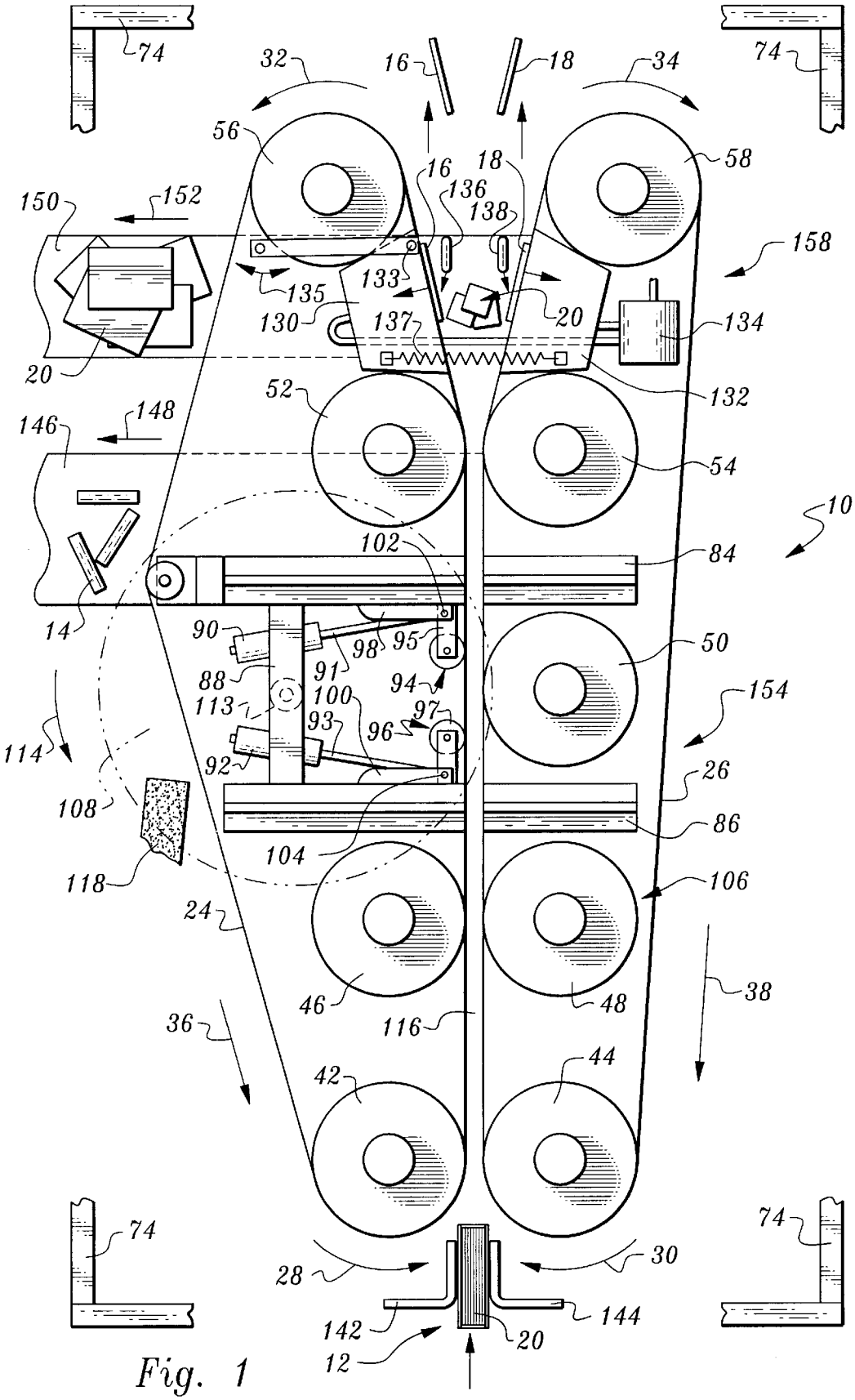
FIG. 1 is a top plan view of the apparatus of the present invention showing portions schematically and the supporting frame of the apparatus in part.

The invention as a whole is shown in the drawings by reference character 10. Apparatus 10 is intended to separate parts of book 12 for recycling the same. It has been found that the pages 20 of book 12 are far more easily recyclable than binding or spine 14, or the cover portions 16, 18 of book 12 due to incompatible materials found in the latter portions. In this regard, book 12 is shown in the drawings as a typical book which may be processed by apparatus 10. Book 12 includes a hard binding or spine 14 and a pair of hard covers 16 and 18. Plurality of pages 20 lie between cover 16 and 18, best shown in FIGS. 1 and 2.

Figure 3:
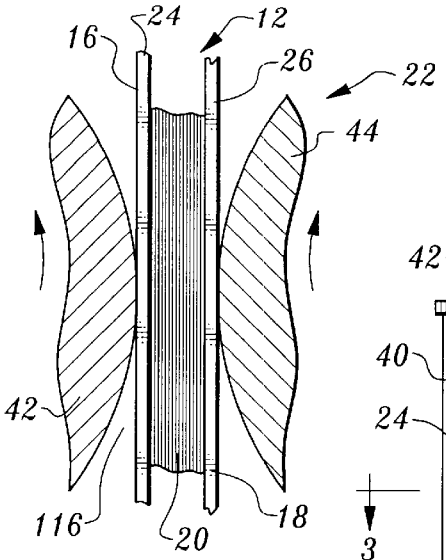
FIG. 3 is a sectional view taken along line 3–3 of FIG. 2.
Figure 2:
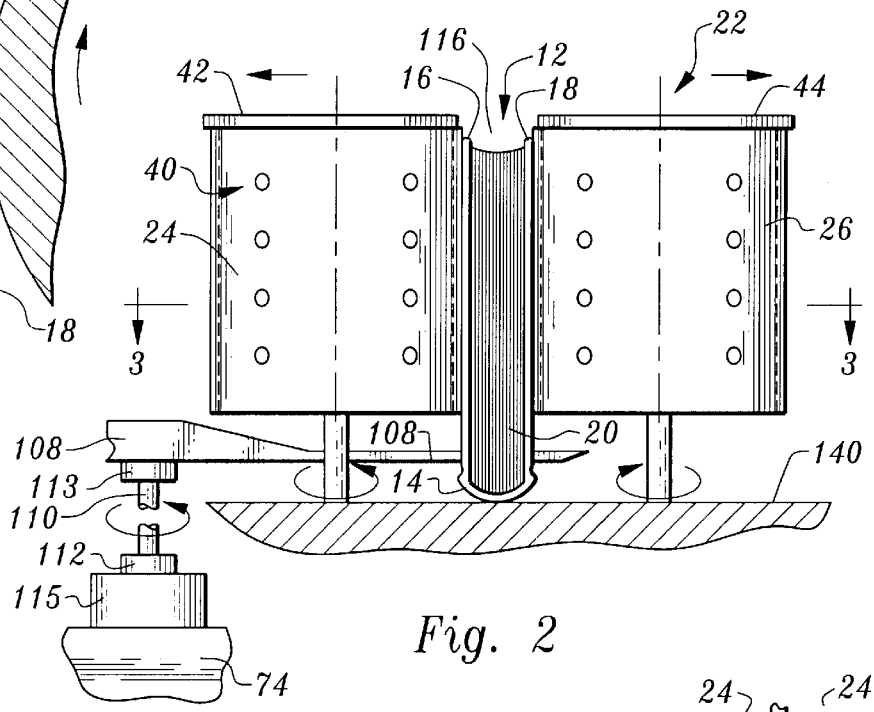
FIG. 2 is an end view of the book feeding entrance to the apparatus depicted in FIG. 1 depicting the cutting blade in portion.

Apparatus 10 includes as one of its elements, a holding structure 22 for supporting book 12 in a certain position such that spine or binding 14 extends outwardly from structure 22, FIGS. 2 and 3. With reference to FIG. 2, such outward orientation or exposure of book 12 is depicted. Holding structure 22 takes the form of closed loop belts 24 and 26 which counter-rotate according to directional arrows 28 and 30, 32 and 34, and 36 and 38, FIG. 1. Belts 24 and 26 may take the form of three-ply, polynitrite material, clipper laced 3/16 inch thick belts. Belts 24 and 26 include plurality of perforations 40, therethrough. The function of perforations 40 will be discussed in detail hereinafter.

Belts 24 and 26 contact plurality of pulleys or rollers 106 such as rollers 42, 44, 46, 48, 50, 54, 56, and 58. Each roller or pulley may have a MCSP 10 inch face, 8 inch diameter of crowned or straight configuration pulleys, having a 1½ inch bushing. In this regard, the outer surface 60 of roller 46 contacts belt 24 freely.

Figure 4:
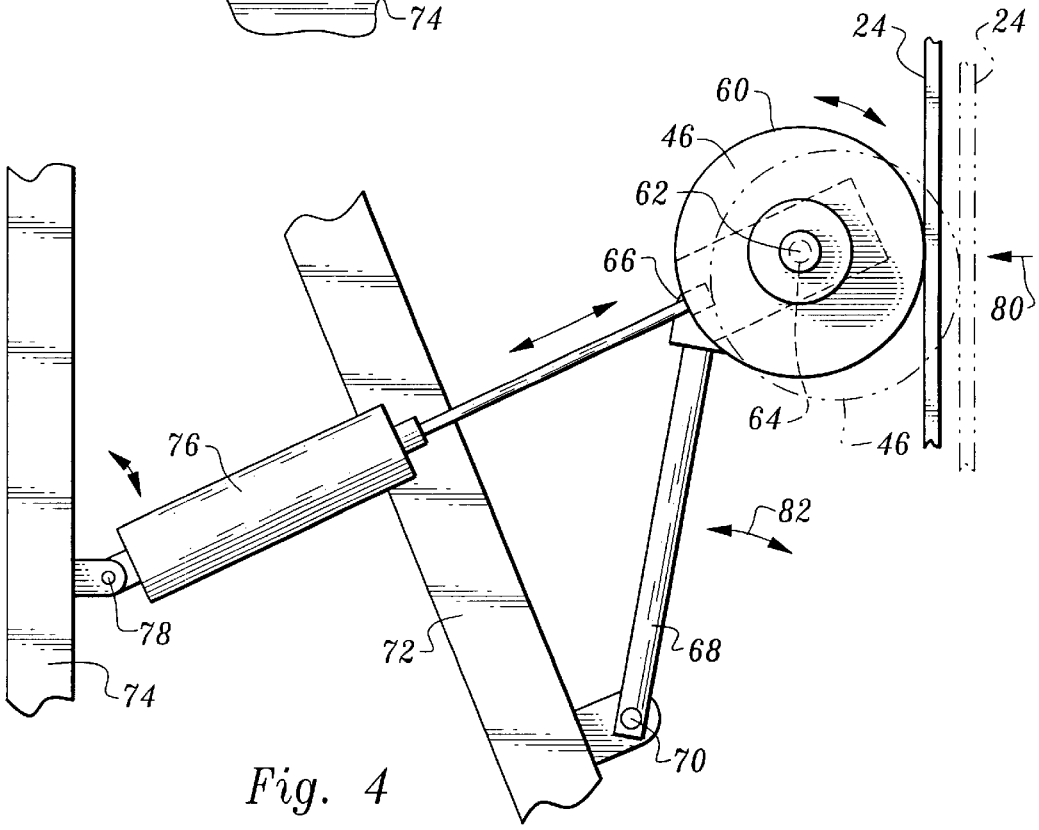
FIG. 4 is a top plan view depicting the biasing mechanism of one of the movable rollers employed in the present invention.

Roller 46 depicted in FIG. 4, rotates about axis 62 which is the center of a shaft 64 that extends to a base member 66. However it should be understood that rollers 42, 46, and 52 include a similar structure. The base member 66 connects to an arm 68 that rotates about pivot 70. Arm 68 is fastened to a structural member 72 which is part of frame 74, shown, in part, on FIG. 1 and FIG. 4. It should be noted that frame 74 is of conventional configuration and rigidly supports structural member 72. Pneumatic cylinder 76 pivotally connects to structural member 74 through tab 78 and contacts base 66 of roller 46. For example, each cylinder, such as cylinder 76 may take the form of one manufactured by Schrader Bellow of Des Plaine, II having a 2.5 inch bore, 6.0 inch stroke, rated to 150 psi and sold under model SPU16. Thus, any force on belt 24, represented by directional arrow 80, pushes roller 46 into the position shown in solid line on FIG. 4. Arm 68 has rotated about pivot 70 according to directional arrow 82. Also, pivot 78 has slightly rotated the orientation of pneumatic cylinder 76. Removal of the force, represented by directional arrow 80, will cause roller 46 to move back into the position shown in phantom on FIG. 4 with the consequent movement of belt 24 in that direction. Thus, as book 12 travels between belts 24 and 26, rollers 42, and 52 move in a similar manner to roller 46 as depicted in FIG. 4. It may be apparent that channel 116 between belts 24 and 26 is depicted as being partially opened on FIG. 1, but normally exists only in the vicinity of rollers 56 and 58, until book 12 moves with belts 24 and 26. In addition, it should be apparent that structural beams 84 and 86 traverse, and are connected to, frame 74. Structural member 88 serves as a crosspiece between beams 84 and 86.

Pneumatic cylinders 90 and 92 connect to frame 74 and lie beneath cross piece 88. Cylinders 90 and 92 urge roller pairs 94 and 96 into contact with belt 24, in general opposition to the contact of roller 50 with belt 26. It may be seen that roller pairs 94 and 96 mount on bars 95 and 97, respectively, and pivotally connect to curved flanges 98 and 100 such that the shafts 91 and 93 of cylinders 90 and 92 rotate roller pairs 94 and 96 against belt 24, about 102 and 104, respectively.

Figure 7:
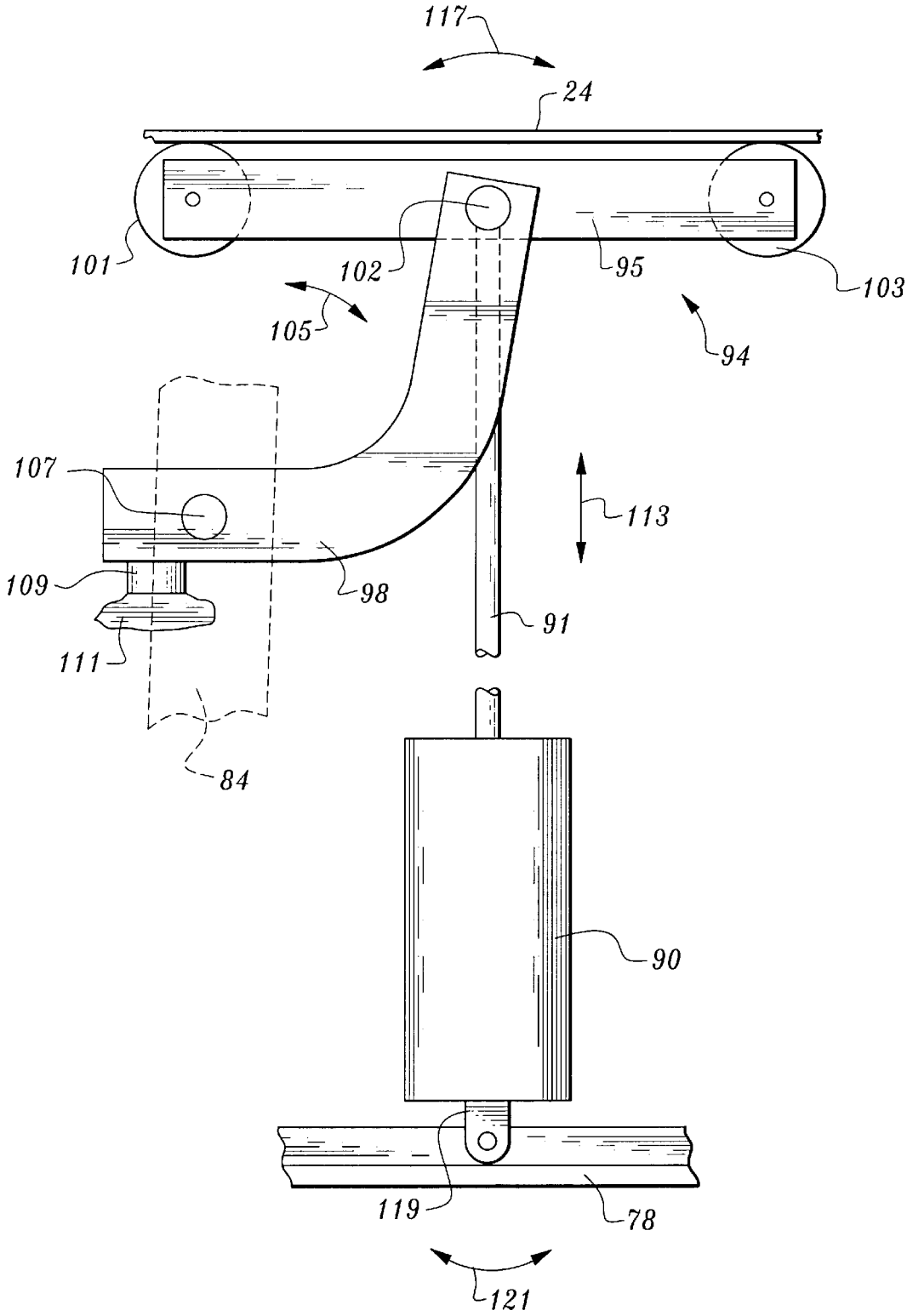
FIG. 7 is a broken top plan view of the roller mechanism found in the vicinity of the binder cutting operation using the apparatus of the present application.

FIG. 7 depicts roller pair 94, in detail and includes rollers 101 and 103. Curved flange 98 rotates according to directional arrow 105 about pivot 107, which connects to beam 89 which is a portion of frame 74. Stop 109 impinges on curved flange 98 and is held by member 111 connected to beam 84. Shaft 91 of cylinder 90 moves according to directional arrow 113. Directional arrow 117 represents the rotation of bar 95 about pivot 102. Finally, tab 119 permits cylinder 90 to rotate according to directional arrow 121. With the above described arrangement, roller pair 94 tightly holds book 12 against belt 24 and, consequently, against belt 26 for trimming by cutter 108, discussed hereinafter. It should be understood that roller pair 96 operates in a similar manner to roller pair 94.

A blade or cutter 108 is also depicted in the present invention for severing the binding from book 12. Cutter 108 is in the form of a disk shaped wheel that rotates about a shaft 110, FIG. 2. Blade or cutter 108 may take the form of a 24 inch diameter can't saw blade manufactured by Simmons industries, Inc. of Fitolfborg, Mass. Shaft 110 is supported by a pair of bearings 112 and 113 as depicted in FIG. 2 beneath cutter 108. Bearings 112 and 113 are connected to a portion of frame 74 in a conventional manner. Thus, cutter 108 rotates according to directional arrow 114 by the use of motor and gear box 115, supported by frame 74. Motor and gearbox 115 may take the form of a U.S. Motor, 2HP, 3 phase 1750 R.P.M., 208–240–460 volt electric motor having a gear box under the designation 3750.140 LR with a 40-1 input, and an 2.19 HP output, with a torque rating of 3320 I.P. manufactured by Browning Inc. of Marysville, Ky. Cutter 108 contacts book 12 and severs spine or binding 14 therefrom as book 12 travels through channel 1.16 between moving belts 24 and 26. Cutter 108 is continually sharpened by a diamond wheel 118 mounted on the edge of cutter 108 attached to frame 74. Diamond wheel 118 may be of the type manufactured by Norton Company of Worcester, MA, under the designation 903609-004F5.

Figure 5:
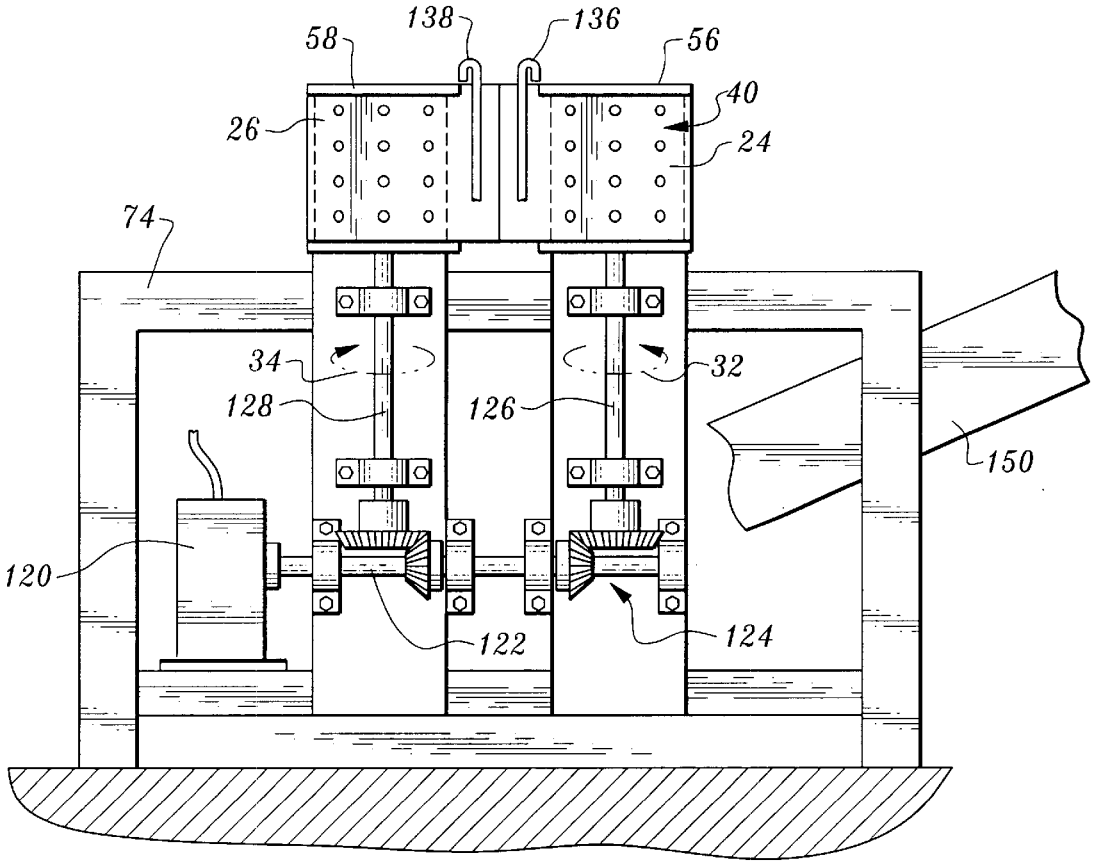
FIG. 5 is a rear elevational view of the apparatus of the present invention depicting the means for conveying books through the apparatus of the present invention.

Turning to FIG. 5, it may be observed that the driving mechanism for apparatus 10 is shown using motor and gearbox 120 which rotates a shaft 122. Motor and gearbox 120 may take the form of a U.S. Motor, 2 HP, 3 phase, 1750 R.P.M. 208–240–460 volt electric motor. The associated gearbox may take the form of a gearbox under the designation 3750.140 LR40, having a 40-1 ratio input at a torque of 3320 I.P. manufactured by Browning, Inc. of Marysville, Ky. Through gearing arrangement 124, the shafts 126 and 128 of rollers 56 and 58 are turned according to directional arrows 32 and 34, FIG. 1. Thus, rollers 56 and 58 serve as the driving mechanism for counter rotating belts 24 and 26 about the remainder of plurality of rollers 106.

Referring again to FIG. 1, vacuum boxes 130 and 132 are shown. Vacuum box 130 lies against belt 24 between rollers 52 and 56, while vacuum box 132 lies against belt 26 between rollers 54 and 58. Vacuum box 130 pivots about rod 133 according to directional arrow 135. Spring 137 bias vacuum box 130 toward vacuum box 132. A vacuum is generated to vacuum boxes 130 and 132 by vacuum pump or fan 134 supported to frame 74. Vacuum pump 134 may each take the form of which pressure direct drive blower under designation 7C487, with a 13½ inch wheel and a 5 HP motor mounted on frame 184T, at 3600 R.P.M., and an electrical source requirement of 208–240–460 volts. A vacuum is exerted at the surfaces of belts 24 and 26 facing channel 116 via perforations 40. Air exiting vacuum pump 134 is directed to exit conduits 136 and 138, best shown in FIG. 5, direct air down along the outer surfaces of belts 24 and 26 respectively, to aid in the removal of pages 20 from covers 16 and 18.

Figure 6:
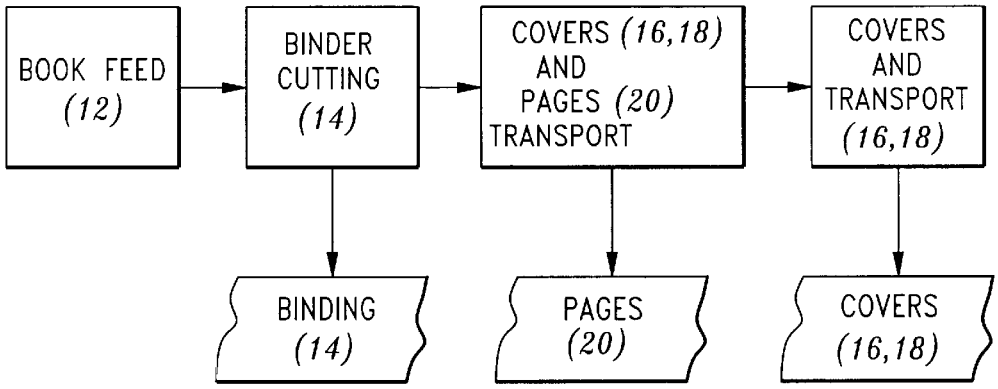
FIG. 6 is a block diagram outlining the process accomplished by the apparatus of the present invention.

Apparatus 10 follows a process shown in FIG. 6 in which a book 12 enters apparatus 10 at surface 140, FIG. 2. Book 12 is fed through guides 142 and 144 and through channel 116 between belts 24 and 26 biased by plurality of rollers 106, FIG. 1. The force exerted by plurality of rollers 106 on moving belts 24 and 26 hold book 12 in the position depicted in FIG. 2 until book 12 reaches cutter 108. Roller pairs 94 and 96 hold book 12 securely within belts 24 and 26 and against roller 50. At this point, cutter 108 severs binding 14 from book 12. Binding 14 falls into a conveyor 146 and is removed according to directional arrow 148. Following removal of binding 14 from book 12, roller 52 and 54 maintain the position of covers 16 and 18 as well as pages 20 between belts 24 and 26 within channel 116. However, following passage of these book portions through channel 116, vacuum boxes 130 and 132 firmly hold covers 16 and 18 against belts 24 and 26 respectively. Vacuum box 130 pivots according to directional arrow 135 to accommodate books of varying thicknesses. At this point, the pages 20 drop downwardly into conveyor 150 and are removed according to directional arrow 152. Covers 16 and 18 are carried forward by perforated belts 24 and 26 and collected at the end of apparatus 10 beyond rollers 56 and 58. Thus, plurality of rollers 106 and belts 24 and 26 serve as means 154 for conveying book 12 from the vicinity of feed guides 142 and 144 to contact with cutter 108. In addition, the same structure serves as means 156 for conveying covers 16 and 18 as well as pages 20 from contact with cutter 108. Finally, vacuum boxes 130 and 132 and perforated belts 24 and 26 serve as means 158 for separating cover portions 16 and 18 from pages 20 of book 12.

As noted FIG. 6 depicts, in block form, the process followed by apparatus 10 to separated binding 14, pages 20, and covers 16 and 18, sequentially, from book 12. Thus, pages 20 may be easily recycled while binding 14 and cover 16 and 18 may be discarded or separately recycled, as the case may be.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. Apparatus for continuously transporting a book having a spine, cover portions and pages and for separating the spine, cover portions and pages of the book during continuous transport of said book by the apparatus, said apparatus comprising, in combination:

support structure having a support surface for engaging the spine of the book to support the book with the book extending upwardly from the support surface;

a conveyor for continuously transporting the book along a predetermined path of movement with the cover portions and pages thereof extending upwardly from the spine thereof including two movable conveyor belts disposed on opposed sides of the book and including parallel, generally vertically oriented book engagement surfaces for engaging the cover portions of the book and exerting opposed compressive forces on the book during book transport by the conveyor, the support surface of the support structure being below the level of the conveyor belts and positioning the book during transport of the book by the conveyor belts so that the spine of the book is positioned away from said conveyor belts, said conveyor belts defining perforations;

a generally horizontally disposed rotatable cutter blade spaced from said support structure and spaced from said conveyor belts for engaging the book at a location on the book positioned between said support surface and said conveyor belts during continuous transport of the book by the conveyor with the book in engagement with said support structure to sever the spine thereof from the cover portions and pages thereof along a line of severance substantially parallel to said path of movement, said conveyor belts operable to move said cover portions and pages away from the severed spine; and separator structure spaced from said rotatable cutter blade, said separator structure including vacuum applicators in communication with the perforations defined by said conveyor belts to apply a vacuum through said conveyor belts to both of said cover portions, said conveyor belts diverging away from one another at a location spaced from said rotatable cutter blade to move said cover portions away from one another and away from said pages after severing of the spine from the rest of the book by the rotatable cutter blade.

2. The apparatus according to claim 1 additionally comprising biasing means for urging said conveyor belts toward one another with the book positioned between said book engagement surfaces.

3. The apparatus according to claim 1 wherein said conveyor belts form closed loops.

4. The apparatus according to claim 1 wherein said conveyor includes at least a first and a second rotatable spindle contacting one of said conveyor belts and a third and a fourth rotatable spindle contacting the other of said conveyor belts.

5. The apparatus according to claim 4 wherein said conveyor includes a motor operatively associated with at least one of said rotatable spindles for rotating said at least one rotatable spindle.

* * * * *